United States Patent [19]

Terzian

[11] 4,194,352

[45] Mar. 25, 1980

[54] COMPACT, MULTI-FUNCTIONAL DIGITAL TIME DISPLAYS

[76] Inventor: Berj A. Terzian, 66 Hirst Rd., Briarcliff Manor, N.Y. 10510

[21] Appl. No.: 932,921

[22] Filed: Aug. 11, 1978

Related U.S. Application Data

[63] Continuation-in-part of Ser. No. 861,115, Dec. 16, 1977, and Ser. No. 886,121, Mar. 13, 1978.

[51] Int. Cl.[2] ..... G04B 19/30

[52] U.S. Cl. ..... 368/239; 340/756

[58] Field of Search ..... 340/756, 765; 58/50 R; 350/336

[56] References Cited

U.S. PATENT DOCUMENTS

| | | | |
|---|---|---|---|
| 3,827,043 | 7/1974 | Maezawa | 340/756 |
| 3,971,012 | 7/1976 | Morokawa et al. | 340/756 |
| 4,092,638 | 5/1978 | Ripley | 340/756 |

*Primary Examiner*—J. V. Truhe
*Assistant Examiner*—J. Conklin
*Attorney, Agent, or Firm*—Eyre, Mann, Lucas & Just

[57] ABSTRACT

A 13-element array of digital time display elements is selectively energizable to display relatively large hour digits of value 0 to 9, or relatively small minute digits of value 0 to 9 in a relatively upper or a relatively lower position. Three such arrays, together with two vertical line display elements, in ordered horizontal alignment, provide a compact, multi-functional display capable of performing balanced or quadribalanced digital time keeping. Four such arrays aligned horizontally provide another compact, multi-functional display capable of performing balanced, quadri-balanced or chronographic digital time keeping.

23 Claims, 7 Drawing Figures

COMPACT, MULTI-FUNCTIONAL DIGITAL TIME DISPLAYS

CROSS-REFERENCE TO RELATED APPLICATIONS

This application is a continuation-in-part of copending applications Ser. No. 861,115, filed Dec. 16, 1977 and Ser. No. 886,121, filed Mar. 13, 1978.

BACKGROUND OF THE INVENTION

1. Field of the Invention

This invention relates to time keeping and, more particularly, to the use of digital time displays for general purpose time keeping. The term "general purpose", as applied to digital time displays or digital time keeping in context of the ensuing description, is used qualitatively to refer to the general time keeping needs and practices of ordinary individuals occupied with their usual activities on a day-to-day basis, as distinguished from specialized time monitoring procedures used in particular circumstances, e.g., scientific experiments, computer operations, games and sporting events, etc.

2. Description of the Prior Art

General purpose digital time displays have been available to consumers over the past several years in a variety of products, e.g. wrist watches, clocks, clock-radios and numerous other articles. Such displays generally consist of a horizontal array of hour and minute digits separated by a colon, with the hour digits positioned to the left and the minute digits to the right, and with the minute digits being driven to count values up from 01 to 59 and, one minute later, to reset to 00, with a simultaneous increase in the value of the hour digits to that of the next hour. On occasion, with liquid crystal type displays, second digits are also provided, positioned to the right of the minute digits and also driven to count seconds up from 01 to 59, with resetting to 00 one second later, when the value of the minute digits is increased to the next minute. In other instances, such as with light emitting diode type displays, switching is employed to display second digits alone, counted as described above but without a simultaneous display of hour and minute digits.

Although such displays and products have been commercially successful, they have not displaced completely, or even to a major extent, their analog counterparts and competition. The latter are based upon the conventional twelve-hour dial face with hour, minute and, optionally, second hands rotating through 360° to indicate the time by the progressive positions of the hands relative to spaced markings applied along the dial perimeter. Many consumers, both prospective and actual, have found currently available general purpose digital time displays to be inconvenient, awkward, difficult to use or otherwise objectionable in comparison to analog time displays, and often because of poorly perceived or definable reasons.

Although its appears to be commonly accepted that conventional general purpose digital time displays excel in informing the user of the present time at the moment of the readout, it is also recognized that burdensome mental calculations are required to translate that readout in the viewer's mind into grosser time contexts, e.g. the position of the precise time relative to a larger interval such as an hour or half hour, or how much time remains before the next hour or half hour, or how much time has passed or is to pass in relation to the occurrence of other exact times as previous or future references. Thus, conventional general purpose digital time displays suffer from the basic drawback of isolating the present time without also providing rapidly comprehendible indications of the larger time contexts which individuals ordinarily rely upon to carry out their general activities and for which analog time displays are far superior because of the graphic overall picture of gross time presented by their hand positions relative to the dial face markings. These and like problems in the use of conventional digital time displays have been described specifically, for example, in a survey reported in the November 1976 issue of Consumer Reports (Vol. 41, No. 11), a well known consumer products evaluation journal.

SUMMARY OF THE INVENTION

Balanced and quadri-balanced digital time display systems and methods for minimizing or avoiding the above problems associated with conventional digital time displays are described in co-pending applications Ser. No. 861,115, filed Dec. 16, 1977, and Ser. No. 886,121, filed Mar. 13, 1978. The disclosures of those applications are incorporated herein by reference as background to the present invention, which provides alternatives and improvements for the previously-described systems and methods.

More particularly, the previous systems comprise five or six 7-element or 10-element arrays of digital time display elements arranged in a horizontal row, each array being selectively energizable to display digits of value 0 to 9. Use of such groups of five or six arrays results in the appearance of vacant spaces in nearly half or more of the display background as the arrays undergo the various changes in digit formats, values and readout positions to display balanced or quadri-balanced digital time keeping. The appearance of such spaces has the advantage of reinforcing in the viewer's mind the time significance of the shifting geometries presented by the displays, as described in the previous patent applications.

However, since a significant portion of the display background is not used for digit displays at any given time during operation of the previously described systems, there is a limitation on the minimum overall horizontal dimension of such displays. In particular, since alternating pairs of arrays in the array groups of five or six become de-activated and blanked during operation of the previous systems but all of the groups nevertheless are provided in the same background, the minimum horizontal width the displays is limited to the space needed for the totalities of such array groups, within the further constraint of the overall sizes thereof being large enough to display easily readable digits.

The present invention provides a remedy for those instances in which it may be desired to implement balanced or quadri-balanced digital time keeping as previously disclosed, but without the above-mentioned vacant spaces and the limitations on minimum horizontal dimensions. The present invention in its broadest sense comprises a 13-element array of digital time display elements which may be selectively energized to display relatively large hour digits of value 0 to 9, or relatively small minute digits of value 0 to 9 in either a relatively upper or a relatively lower position.

This three-way functionality enables grouping three of the 13-element arrays with two vertical line display elements in an ordered horizontal alignment to carry out balanced or quardribalanced digital time keeping, substantially without the vacant spaces of the previous systems. Moreover, by eliminating the need for two 0–9 digit displaying arrays, compared to the previous minimum number of five, the minimum horizontal width of the arrangement of the present invention is substantially reduced to provide a more compact, multi-functional display.

The new 13-element array also may be used in a horizontal group of four to obtain a display which is capable of carrying out balanced, quadri-balanced or chronographic digital time keeping, with the last being unambigously distinguished by its geometry from the first two. This multi-functional group of four arrays is also more compact than the previously-described minimum number of five, due to elimination of the need for one 0–9 digit displaying array.

If desired, the compact, multi-functional displays of the present invention can include a seconds display of the kind described in the previous patent applications. This is done preferably by positioning a pair of 7-element arrays at the center of and below the horizontal groups of 13-element arrays, and by activating such pair to count seconds up from 01 to 30 and then down from 29 to 00 in synchronism with the interval of each minute. The advantage of such arrangement is that the smallest tine interval being displayed (seconds) is presented at the lowest level to the viewer's line of sight, which provides a logical order relative to the scale of time magnitudes and which minimizes distraction from the display of hours and minutes above, the latter usually having more important significance to the viewer's general time keeping needs.

Other features and advantages of the invention will be evident from the subsequent detailed description, taken in connection with the drawings.

DESCRIPTION OF THE PREFERRED EMBODIMENTS

Figure 1:
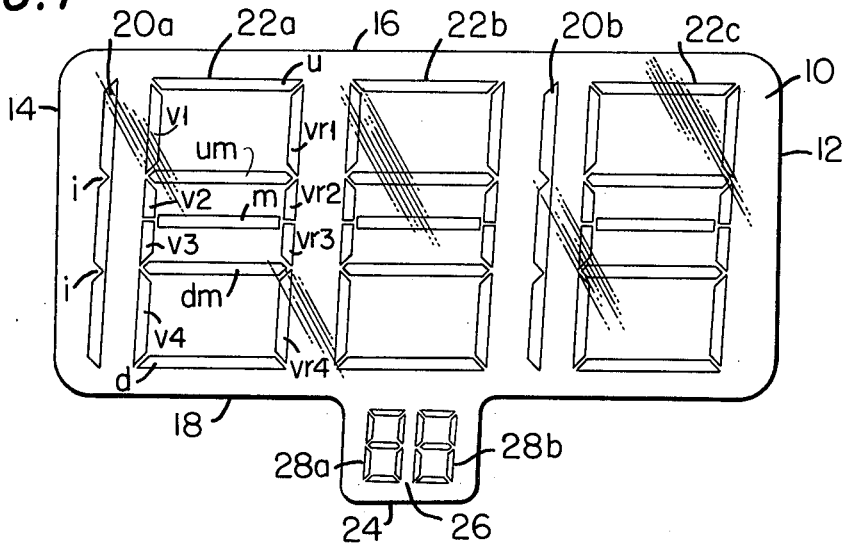
FIG. 1 is a front view of a compact, multi-functional digital time display using three 13-element arrays in accordance with one embodiment of the invention.

Referring to FIG. 1, illustrated there is a horizontally oriented background 10 outlined by side perimeters 12 and 14, and upper and lower perimeters 16 and 18. Substantially filling background 10 are two energizable vertical line display elements 20*a* and *b*, and three 13-element arrays of energizable display elements 22*a*, *b* and *c*, aligned horizontally in the order 20*a*, 22*a*, 22*b*, 20*b* and 22*c*.

The lower perimeter 18 includes a central, downwardly projecting U-shaped extension 24 which defines a smaller, lowermost display background 26. In it is a pair of 7-element arrays of energizable display elements 28*a* and *b*, each array of which may be selectively energized to display digit values from 0 to 9, so that the pair can be used to display digit values of seconds from 01 up to 30 and then down from 29 to 00 during each minute interval.

Referring to the first of the 13-element arrays 22*a*, as illustrative of all three, 22*a*, *b* and *c*, it includes five horizontal display elements, one, designated "u", in an uppermost position and another, designated "d", in a lowermost position, the vertical distance in between comprising the overall height of the array. Two of the remaining three horizontal elements are positioned in between the outermost elements u and d, one, designated "um", above the horizontal mid-line of the vertical distance between u and d, and the other, designated "dm", below the mid-line. Elements um and dm are preferably spaced approximately equal from each other and from, respectively, the outermost elements u and d, so that they divide the vertical distance between the latter into approximately equal one-third parts. The fifth horizontal element, designated "m", is positioned preferably at the mid-line of the distance between the outermost elements u and d, which position also coincides with the mid-line of the distance between the internal horizontal elements um and dm in the illustrated embodiment.

The left ends of the horizontal elements u, um, m, dm and d are in substantial vertical alignment and bridged by a set of four vertical elements designated from top to bottom as "v1", "v2", "v3" and "v4". Similarly, the right ends of the horizontal elements are in substantial vertical alignment and bridged by a set of four vertical elements designated as "vr1", "vr2", "vr3" and "vr4". A small rightward mis-alignment of all the elements from true vertical is preferably incorporated to achieve digit displays slanting vertically to the right for a more pleasing appearance.

The adjoining ends of the horizontal and vertical elements are separated by narrow spaces, as illustrated, to isolate and permit each element to be electrically energized independently of the others. In this connection, all the joints between the proximate ends of the horizontal elements u, um, dm and d and of the vertical elements v1–4 and vr1–4 adjoining thereto are mitered. In contrast, the proximate ends of the horizontal element m and of the vertical elements v2, v3, vr2 and vr3 adjoining thereto are squared off to form butt joints. This is preferred in order to present maximum visual continuity through the vertical elements during energization of the array to display digits, without loss of significant horizontal continuity whenever the horizontal element m is energized to display large hour digits, as will be evident from further description below.

All the elements of the 13-element array 22*a* and the preferred positions thereof relative to each other have been described. The three-way functionality achieved by this array will now be pointed out.

The horizontal elements u, m and d and all the vertical elements v1–4 and vr1–4 can be selectively energized in combinations to display hour digits of value 0 to 9 having a height corresponding to the distance between elements u and d, and thus being relatively large.

Horizontal elements u, um and dm and vertical elements v1–3 and vr1–3 can be selectively energized in combinations to display minute digits of value 0 to 9 having a height corresponding to the distance between elements u and dm, which also comprises the upper two-thirds of the distance between elements u and d. Thus, these minute digits are relatively smaller than the hour digits and in a relatively upper position.

Horizontal elements um, dm and d and vertical elements v2–4 and vr2–4 can be selectively energized in combinations to display minute digits of value 0 to 9 having a height corresponding to the distance between elements um and d, which also comprises the lower two-thirds of the distance between elements u and d. Thus, these minute digits are relatively smaller than the hour digits and in a relatively lower position.

The above description of the 13-element array 22*a* and its functional capabilities applies equally to the identical arrays 22*b* and 22*c*.

In addition to the three 13-element arrays 22*a–c*, the FIG. 1 embodiment includes the vertical line display elements 20*a* and *b*, which have a height substantially equal to the distance between the horizontal elements u,d and which are used to display the tens unit values in the hour digits 10, 11 and 12. These vertical line display elements, although each a single element electrically energizable across its entire height at a given time, are preferably provided with the illustrated indentations, designated "i", positioned at the levels corresponding to the vertical positions of elements um and dm in the adjacent 13-element arrays 22*a* and 22*c*, and shaped to complement the appearance of the mitered joints of the latter when hour digits of 10 or higher are displayed.

Figure 2:
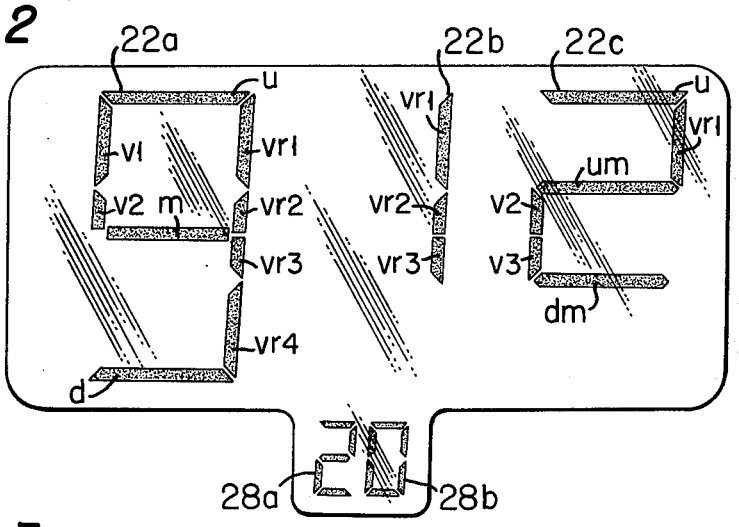
FIG. 2 is a similar view showing the FIG. 1 embodiment in a representative first quarter or first half hour display.

Referring to FIG. 2, illustrated there is the FIG. 1 embodiment energized to display the large leading hour digit "9" and the relatively smaller trailing minute digits "12" in a relatively upper position. The hour digit is displayed by energization of the horizontal elements u,m,d and the vertical elements v1, v2 and vr1–4 of array 22*a*. The minute digit "1" corresponds to energization of vertical elements vr1,2 and 3 of array 22*b*. The minute digit "2" is achieved by energization of horizontal elements u,um,dm and vertical elements v2,3 and vr1 or array 22*c*.

Thus, FIG. 2 is capable of displaying leading relatively large hour digits of value 1 to 12 (element 20*a* being energized also for hours 10–12) and trailing relatively small minute digits of value 00 to 30 for the first half of each hour, pursuant to balanced digital time keeping disclosed in the previous patent application directed thereto. Alternatively, the same FIG. 2 display may be used to display minute digit values of 00 to 15 during the first quarter of each hour, pursuant to quadri-balanced digital time keeping disclosed in the previous patent application directed thereto. In addition, the array pair comprising 28*a* and *b* has been energized in FIG. 2 to display second digits of value 20, which indicates whether the twelfth minute (after the ninth hour) is in its first or second half, depending on whether value 20 is within the count up of seconds from 01 to 30 or down from 29 to 00, as disclosed in both of the previous patent applications.

Figure 3:
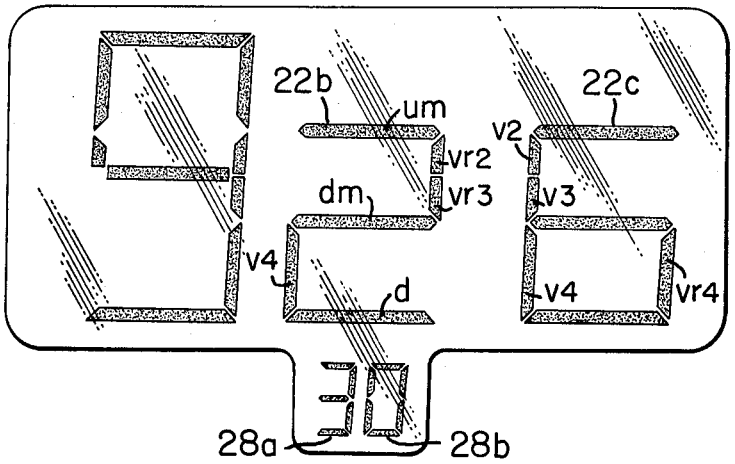
FIG. 3 is a similar view showing the FIG. 1 embodiment in a representative second quarter hour display.

Referring to FIG. 3, the hour digit 9 is the same as in FIG. 2. The minute digits show value 26 in a relatively lower position compared to FIG. 2. The minute digit 2 corresponds to energization of horizontal elements um,dm,d and vertical elements v4,vr2 and 3 of array 22*b* of FIG. 1. The minute digit 6 corresponds to energization of the same horizontal elements and vertical elements v2,3,4 and vr4 of array 22*c* of FIG. 1. The second digits show value 30, indicating that exactly half of the twenty-sixth minute has elapsed and that the second half remains. This display, thus, can be used to show minute digit values of 16 to 30 during the second quarter of each hour, pursuant to quadri-balanced digital time keeping.

Figure 4:
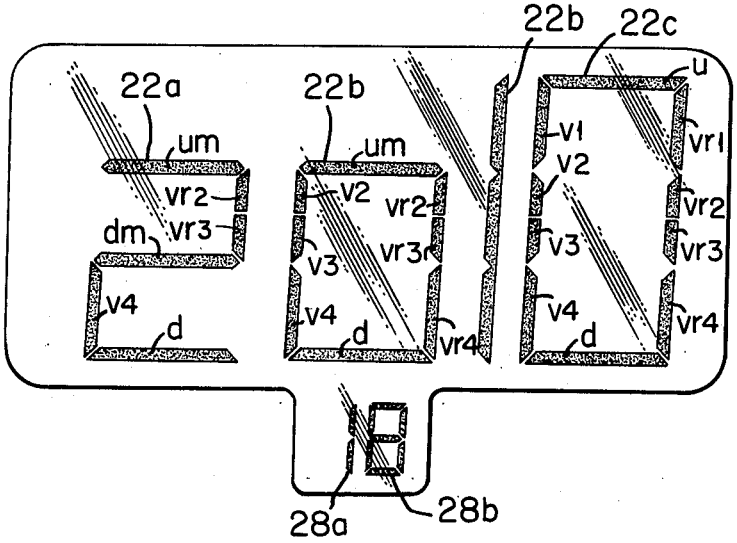
FIG. 4 is a similar view showing the FIG. 1 embodiment in a representative third quarter hour display.

Referring to FIG. 4, illustrated there are relatively small minute digits of value 20 in a relatively lower position and leading the relatively large trailing hour digits of value 10 in the left-to-right readout direction. Minute digit 2 corresponds to energization of horizontal elements um,dm,d and vertical elements v4,vr2 and 3 of the array 22*a*. Minute digit 0 corresponds to energization of horizontal elements um,d and vertical elements v2–4 and vr2–4 of the array 22*b*. Hour digit 1 is displayed by energization of element 20*b*, and hour digit 0 by energization of horizontal elements u,d and all the vertical elements of the array 22*c*. In addition, the array pair 28*a* and *b* has been energized to display 18 seconds. This display indicates that the present time is 20 minutes before the approaching tenth hour (AM or PM) and that 18 seconds of that minute either have elapsed or remain until the next minute, depending on whether the seconds count is progressing up to or down from the peak value of 30. The FIG. 4 display is, therefore, useful to display leading relatively small minutes of values 29 to 16 in a relatively lower position during the third quarter of each hour, pursuant to quadri-balanced digital time keeping.

Figure 5:
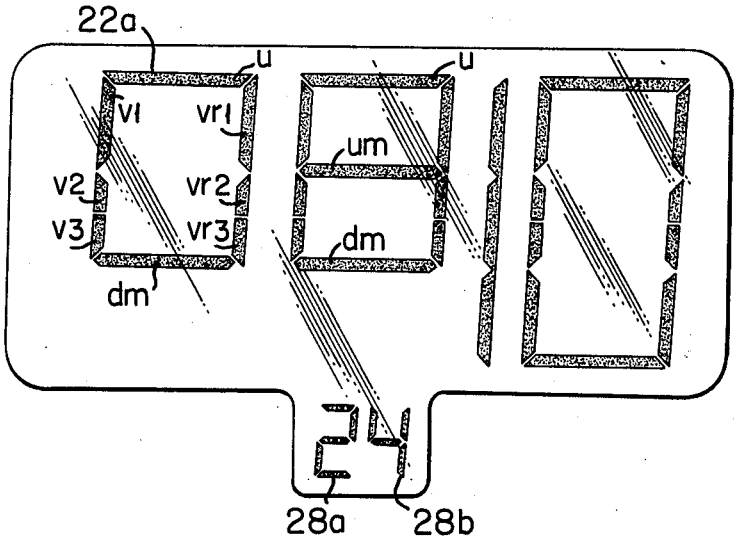
FIG. 5 is a similar view showing the FIG. 1 embodiment in a representative fourth quarter or second half hour display.

Referring now to FIG. 5, illustrated there is energization of the FIG. 1 embodiment to display relatively small minute digits of value 08 in a relatively upper position leading the hour digits of value 10. The minute digit 0 corresponds to energization of horizontal elements u,dm and vertical elements v1–3 and vr1–3 of the array 22*a*. The minute digit 8 is provided by energization of horizontal elements u,um,dm and the same vertical elements of array 22*b* as those of adjacent array 22*a* displaying minute digit 0. The hour digits 10 are the same as in FIG. 4, and the array pair 28*a* and b displays 24 seconds. This display informs the viewer that the present time is eight minutes before the oncoming tenth hour and that either 24 seconds of that minute have elapsed or that 24 seconds remain until the next minute, depending on whether the peak 30-second value is approaching or has passed. The FIG. 5 display, thus, may be used to display relatively small minute digits of value 15 to 01 leading relatively large trailing hour digits during the fourth quarter of each hour, pursuant to quadri-balanced digital time keeping. Alternatively, the same display may be used to display minute digits of value of 29 to 01 in the same relatively small size and leading position during the second half of each hour, pursuant to balanced digital time keeping.

The foregoing description of FIGS. 1–5 brings into specific focus the principal advantages of the present invention. The present displays achieve all the important features of previously disclosed balanced and quadri-balanced digital time keeping. In addition, these displays at all times substantially fill the display background without the appearance of large vacant spaces. Therefore, they may be implemented in smaller physical dimensions, especially in the important horizontal direction of readout, to provide more compact appearances which may be esthetically more attractive to consumers.

In this connection, the butt joints between the proximate ends of the central horizontal element m and of the adjoining vertical elements v2,3 and vr2,3 are highly desirable, since this minimizes the appearance of apparent vertical discontinuities in all digits incorporating these joints and, at most, can only show incompletely cornered joints when the element m is displayed in the hour digits 2,4,5,6 and 9. However, since those hour digits are relatively large in comparison to the minute digits (in which all joints are always mitered or completely butted), esthetic objection to the slightly discontinuous joints at the extremities of element m in the specified hour digits should be minimal.

Still another advantage of the displays illustrated in FIGS. 1–5 is that the identical FIG. 1 arrangement of display elements can be used to carry out either balanced or quadri-balanced digital time keeping. This permits the manufacturer to incorporate in one product, e.g. wrist watch, clock, clock radio, etc., appropriate switching in the circuitry of the previous patent applications, to give the user the option to choose between either timing system at any desired time.

Figure 6:
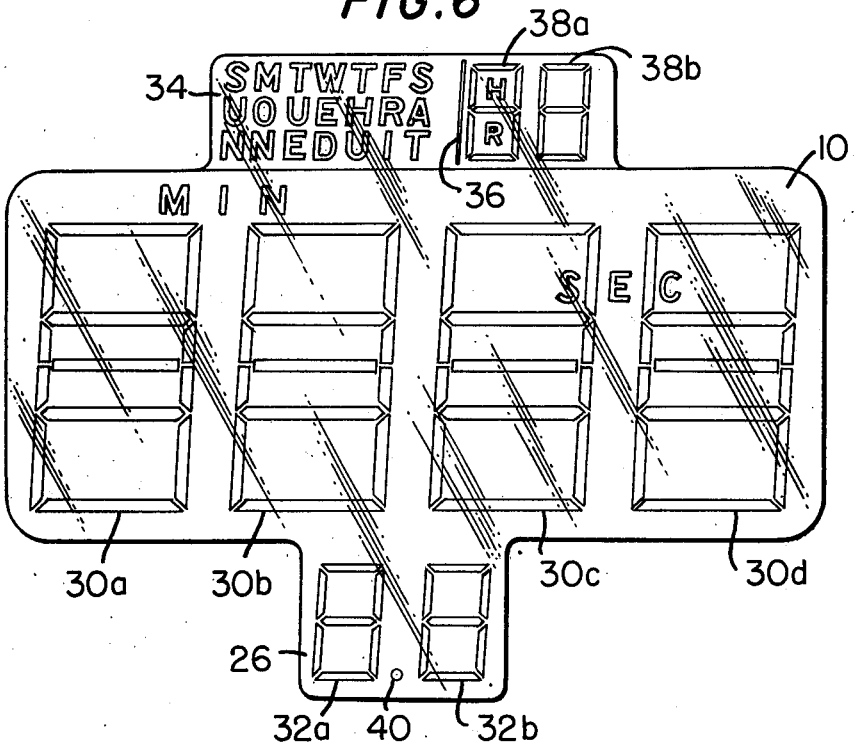
FIG. 6 is a front view of another embodiment of the invention using four 13-element arrays.

Referring now to FIG. 6, illustrated there is another embodiment of the present invention which is based upon the use of four 13-element arrays 30*a,b,c* and *d*, each identical in constituent elements and functional capabilities to the arrays 22*a,b* and *c*. Also in common with the previous embodiment is a pair of 7-element arrays 32*a* and *b* for display of seconds in the same manner as described for the array 28*a* and *b*.

The array group 30*a–d* provides at least the three 13-element array group of FIG. 1, with other vertical display elements as well. Therefore, it will be obvious that the FIG. 6 embodiment also may be energized to display balanced or quadri-balanced digital time keeping, in analogous manner to the description of FIGS. 2–5. For example, in FIG. 6, the array 30*a* may be used to display relatively large leading single-digit hours, and the arrays 30*b* and *c* to display relatively small trailing upper or lower minute digits, during the first halves or first and second quarters of each hour, until display of the tenth hour becomes necessary. At that time, the display of doubledigit hours may be carried out with the arrays 30*a* and *b*, with shifting of the minute digits to 30*c* and *d*, during the specified portions of each such hour. Alternatively, if it is desired to avoid this shift, minute digits can be displayed during the specified portions of all hours by arrays 30*c* and *d*, with the other arrays 30*a* and *b* being used to display relatively large leading single-digit or double-digit hours.

Similarly, during the second halves or third and fourth quarters of each hour, leading relatively small upper or lower minute digits can be displayed by arrays 30*b* and *c*, with relatively large trailing single-digit hours shown by array 30*d*, and with shifting of such minutes to arrays 30*a* and *b* when double-digit hours have to be displayed by arrays 30*c* and *d*. Or, leading minute digits may be displayed by arrays 30*a* and *b* during the specified portions of all hours, with arrays 30*c* and *d* restricted to the display of trailing hour digits at all times, to avoid a similar reverse shift of minute digits as noted above in regard to leading hours and trailing minutes.

In the foregoing alternatives, it is evident that when the minute digits are displayed in their most trailing position (arrays 30*c,d*) or most leading position (arrays 30*a,b*), the FIG. 6 embodiment provides two other energizable 13-element arrays.

Since each of such other arrays can be activated to display hour digits of value 0 to 9, the complete group of all four arrays can be used to display time over a 24-hour cycle in either balanced or quadri-balanced digital time keeping. Therefore, as a first advantage, the FIG. 6 embodiment permits a manufacturer, with suitable circuitry and switching, to give the consumer the option to choose between the four possible combinations of balanced-12-hour, balanced-24-hour, quadri-balanced-12-hour and quadri-balanced-24 hour time keeping, in comparison to the embodiment of FIGS. 1–5 which can display time only over a 12-hour cycle.

Furthermore, the FIG. 6 embodiment is provided with an uppermost horizontal strip display background 34 in which energizable display elements are included for showing vertically-oriented abbreviated names of the days of the week, in "SUN" to "SAT" horizontal order. Background 34 further includes a vertical line display element 36 which may be energized to partition the remainder of the background from the portion containing the abbreviated days of the week. In that remaining portion is an uppermost pair of 7-element arrays 38*a* and *b*, each array being independently energizable to display digits of value 0 to 9. Within the internal unoccupied spaces of array 38*a* are provided energizable vertically-oriented letter displays "HR" as an abbreviation of hour. Within the main display background 10 and above the arrays 30*a* and *b* are provided the energizable letter displays "MIN" as an abbreviation of minutes. Similarly, within the uppermost unoccupied spaces of and between the arrays 30*c* and *d* are placed energizable letter displays "SEC" as an abbreviation of seconds. An energizable dot display element 40 is included at the bottom of the unoccupied space between arrays 32*a* and *b*.

During general purpose time keeping with FIG. 6, in any one of the four possible combinations previously described, the display elements in the uppermost display background 34 are selectively energized to display each day of the week separately, with all the others blanked, and the arrays 38*a* and *b* are energized to display the corresponding date of the month. Accordingly, the line display element 36, the letter display elements "HR", "MIN" and "SEC", and the dot display element 40, are all de-energized and blanked during such operation. Background 34 then serves to inform the user of the current day, its position in the week-long period simulated by the calender-like strip background 34 and its date in the current month.

Figure 7:
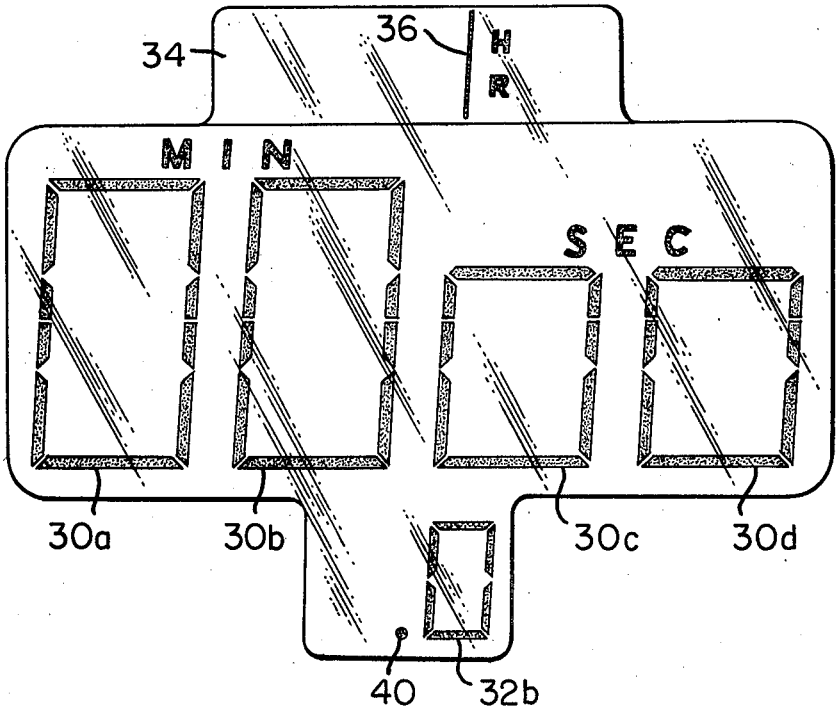
FIG. 7 is a similar view showing the FIG. 6 embodiment in a chronographic timing mode.

FIG. 7 illustrates the conversion of the FIG. 6 embodiment from its above-described general purpose time keeping condition to another appearance suitable for chronographic time keeping. This conversion is achieved by de-energizing and blanking the displays of the day-name and month-date in the uppermost background 34, as well as array 32*a* in the lowermost background 26, and by simultaneously energizing arrays 30*a* and *b* to display relatively large leading zero digits, arrays 30*c* and *d* to display relatively smaller trailing zero digits, array 32*b* to display a relatively still smaller zero digit below the zero digit of array 30*c*, dot element 40 to display a decimal point before the zero digit of array 32*b*, vertical line element 36 to partition background 34 into a relatively small segment to the right, and the letter elements to display the abbreviations "HR", "MIN" and "SEC" in the illustrated positions.

The above-described conversion immediately distinguishes the appearance of the FIG. 7 display from the general time keeping condition of FIG. 6. The unique appearance in FIG. 7 of the zero digits, the decimal point, the partition line, and the letter abbreviations for hour, minute and second, and the simultaneous disappearance of the day-name and month-date and array 32*a*, make it impossible to confuse the time significances of the two appearances.

Moreover, the FIG. 7 display presents an advantageous appearance having a logical order in the scale of time magnitudes for chronographic digital time keeping. In particular, FIG. 7 incrementally steps the viewer's vision down from displays of hours, to minutes, to seconds, to tenths of seconds. The sizes of the latter three digits are graduated in the same order. The partitioned segment at the top reserved for display of hours is maintained blank without a zero digit, since in most instances chronographic time keeping is completed in less than an hour and the distraction of an unnecessary zero digit is, therefore, avoided. In the event of longer intervals, the display of accumulated hour digits in a partitioned segment outside the field containing the minute, second and tenth second digits (backgrounds 10 and 26) also avoids confusion or distraction from the higher frequencies and usually more significant time intervals of the latter three digits in chronographic timing.

Thus, FIG. 7 provides a display for carrying out improved chronographic time keeping in such known ways as accumulated elapsed time, accumulated lap times, accumulated elapsed time with pauses, and count down of a preset time interval. The improvements consist principally of the features described above, i.e. unambiguous distinction of the chronographic time keeping mode from the general purpose time keeping mode provided by the same overall arrangement of display elements, and the more readily comprehendible time significances of the chronographic display appearance. This also enables a manufacturer to provide the user with the option to choose a fifth possible time keeping function with the same product, thus adding still more versatility as a further benefit.

Since the advantages of the chronographic mode reside in the displays of FIGS. 6 and 7 themselves, and since the circuits and methods for energizing digital displays in the above-mentioned specific ways of chronographic timing are per se known, the latter are not part of this invention and are not specifically described herein.

The invention has now been described in terms of its fundamental principles and preferred embodiments thereof. It will be evident to those skilled in the art that it may be implemented with various modifications without departing from its fundamental principles. For example, the display of seconds included in the illustrative embodiments can be eliminated where that degree of precision is not required or desired, and the remaining hour and minute displays will provide all of the other advantages and benefits previously described.

The distance relationships described for the horizontal elements of the 13-element arrays in the illustrative embodiments can be varied. For example, the overall distance between the uppermost and lowermost elements can be increased or decreased, with or without adjustment of the positions of the internal horizontal elements, to retain or change the illustrated dimensional proportions. Similar variations can be made in the width of the arrays.

Although the illustrative embodiments have been described in specific terms of electrically energizable display elements, such as the light emitting diode or liquid crystal displays currently used in conventional digital time displays, the invention may also be implemented with line powered displays or mechanical display elements viewed through open or shuttered apertures or windows. Generally, all forms of display elements which are selectively displayable to display digits in formats, value sequences and readout positions conforming to the principles of the invention may be used to achieve the advantages and improvements described herein.

Accordingly, it will be understood that the invention is not limited to the illustrative preferred embodiments but encompasses the subject matter delineated by the appended claims and all equivalents thereof. For purposes of clarity, it should also be noted that in the claims, the five horizontal elements of the 13-element arrays are recited in terminology defined, respectively, as follows:

| Element | Claim |
|---|---|
| "u" | "highest" |
| "um" | "second highest" |
| "m" | "central" |
| "dm" | "second lowest" |
| "d" | "lowest" |

The following is claimed:

1. Digital time displays which comprise:

(a) a plurality of 13-element arrays of digital time display elements;

(b) each array comprising five horizontal line display elements spaced vertically apart from each other, with the respective left and right ends thereof in substantial vertical alignment;

(c) each array further comprising two sets of four vertical line display elements bridging, respectively, the aligned left ends and the aligned right ends of the five horizontal elements, whereby in each array, (i) the highest, central and lowest horizontal elements and all the vertical elements are selectively displayable in combinations to display relatively large digits, (ii) the highest, second highest and second lowest horizontal elements and the vertical elements bridging the aligned ends thereof are selectively displayable in combinations to display smaller digits, relative to (i), in a relatively upper position, and (iii) the lowest, seocnd lowest and second highest horizontal elements and the vertical elements bridging the aligned ends thereof are selectively displayable to display smaller digits, relative to (i), in a relatively lower position.

2. Digital time displays as in claim 1 in which the second highest and second lowest horizontal elements are spaced apart from each other and from, respectively, the highest and lowest horizontal elements, by distances which are approximately equal and which each is approximately one-third of the total vertical distance between the highest and lowest horizontal elements.

3. Digital time displays as in claim 1 or 2 in which the central horizontal element is positioned approximately mid-way between the highest and lowest horizontal elements.

4. Digital time displays as in claim 1 in which the ends of the highest, second highest, second lowest and lowest horizontal elements and of the vertical elements adjoining thereto are proximate and configured as mitered joints.

5. Digital time displays as in claim 4 in which the ends of the central horizontal element and of the vertical elements adjoining thereto are proximate and configured as butt joints.

6. Digital time displays which comprise:

(a) three 13-element arrays of digital time display elements;

(b) each array comprising five horizontal line display elements spaced vertically apart from each other, with the respective left and right ends thereof in substantial vertical alignment;

(c) each array further comprising two sets of four vertical line display elements bridging, respectively, the aligned left ends and the aligned right ends of the five horizontal elements;

(d) two additional vertical line display elements each having a height substantially equal to the vertical distance between the highest and lowest horizontal elements of the arrays (a); and (e) the arrays (a) and the additional vertical elements (d) being grouped for left-to-right horizontal readout in the order of, first, one of the vertical elements, then two of the arrays, next the second of the vertical elements and, finally, the third of the arrays, whereby in each array, (i) the highest, central and lowest horizontal elements and all the vertical elements are selectively displayable in combinations to display relatively large single digits, (ii) the highest, second highest and second lowest horizontal elements and the vertical elements bridging the aligned ends thereof are selectively displayable in combinations to display smaller single digits, relative to (i), in a relatively upper position, (iii) the lowest, second lowest and second highest horizontal elements and the vertical elements bridging the aligned ends thereof are selectively displayable in combinations to display smaller single digits, relative to (i), in a relatively lower position, and (iv) either of the additional vertical elements is selectively displayable in association with an adjacent 13-element array to display relatively large double digits of at least value 10.

7. Digital time displays as in claim 6 in which the relatively large single and double digits provided by (i) and (iv) are displayed as hour digit values, and the smaller digits provided by (ii) and (iii) are displayed as minute digit values.

8. Digital time displays as in claim 6 which further includes a pair of 7-element arrays of digital time display elements positioned below the group (e) of arrays (a) and additional vertical elements (d), the pair being selectively displayable in combinations to display digit values of seconds from 01 up to 30 and then down from 29 to 00 during each minute interval.

9. Digital time displays as in claim 6, 7 or 8 in which the second highest and second lowest horizontal elements are spaced apart from each other and from, respectively, the highest and lowest horizontal elements, by distances which are approximately equal and which each is approximately one-third of the total vertical distance between the highest and lowerst horizontal elements, and in which the central horizontal element is positioned approximately mid-way between the highest and lowest horizontal elements.

10. Digital time displays as in claim 6 in which the ends of the highest, second highest, second lowest and lowest horizontal elements and of the bridging vertical elements adjoining thereto are proximate and configured as mitered joints, and in which the ends of the central horizontal element and of the bridging vertical elements adjoining thereto are proximate and configured as butt joints.

11. Digital time displays as in claim 10 in which the two additional vertical display elements (d) are provided with indentations, at heights corresponding to the mitered joints of the proximate ends of the second highest and second lowest horizontal elements and of the bridging vertical elements adjoining thereto in the 13-element arrays (a) adjacent to the vertical elements (d), the indentations being configured to complement the appearance of the mitered joints.

12. Digital time displays as in claim 6 within a display background outlined by a perimeter, said displays substantially filling the background without the appearance of large vacant spaces therein during operation thereof.

13. Digital time displays which comprise:

(a) four 13-element arrays of digital time display elements;

(b) each array comprising five horizontal line display elements spaced vertically apart from each other, with the respective left and right ends thereof in substantial vertical alignment;

(c) each array further comprising two sets of four vertical line display elements bridging, respectively, the aligned left ends and the aligned right ends of the five horizontal elements; and (d) the four arrays (a) being grouped for left-to-right horizontal readout, whereby in each array, (i) the highest, central and lowest horizontal elements and all the vertical elements are selectively displayable in combinations to display relatively large digits, (ii) the highest, second highest and second lowest horizontal elements and the vertical elements bridging the aligned ends thereof are selectively displayable in combinations to display smaller digits, relative to (i), in a relatively upper position, and (iii) the lowest, second lowest and second highest horizontal elements and the vertical elements bridging the aligned ends thereof are selectively displayable in combinations to display smaller digits, relative to (i), in a relatively lower position.

14. Digital time displays as in claim 13 which further includes a lowermost pair of 7-element arrays of digital time display elements positioned below the group (d) of the four arrays (a) for presenting digits of smaller overall size than (i), (ii) or (iii), the pair being selectively displayable in combinations to display digit values of seconds from 01 up to 30 and then down from 29 to 00 during each minute interval.

15. Digital time displays as in claim 14 which further includes a display background above the four-array group (d) containing an uppermost pair of 7-element arrays of digital time display elements and containing letter display elements operable to display indicia signifying hours associated with at least one of the uppermost 7-element arrays, and which further includes letter display elements operable for displaying indicia signifying minutes in association with relatively large digits displayed by the first pair of the 13-element arrays in group (d) pursuant to (i) and for displaying indicia signifying seconds in association with relatively smaller digits in a relatively lower position displayed by the second pair of the 13-element arrays in group (d) pursuant to (iii), and which further includes a dot display element operable for displaying a decimal point in association with digits displayed by one of the arrays of the lowermost pair of 7-element arrays, whereby chronographic digital time keeping may be carried out to display hour, minute, second and tenth second digits having downwardly stepped appearances in the order of the largest to the smallest of such time magnitudes and with the minute, second and tenth second digits being graduated in overall size in the same order.

16. Digital time displays as in claims 13, 14 or 15 in which the second highest and second lowest horizontal elements are spaced apart from each other and from, respectively, the highest and lowest horizontal elements, by distances which are approximately equal and which each is approximately one-third of the total vertical distance between the highest and lowest horizontal elements, and in which the central horizontal element is positioned approximately mid-way between the highest and lowest horizontal elements.

17. Digital time displays as in claim 13 in which the ends of the highest, second highest, second lowest and lowest horizontal elements and of the bridging vertical elements adjoining thereto are proximate and configured as mitered joints, and in which the ends of the central horizontal element and of the bridging vertical elements adjoining thereto are proximate and configured as butt joints.

18. Digital time displays as in claim 13 within a display background outlined by a perimeter, said displays substantially filling the background without the appearance of large vacant spaces therein during operation thereof.

19. An array for use in digital time displays which comprises:

(a) five horizontal line display elements spaced vertically apart from each other, with the respective left and right ends thereof in substantial vertical alignment; and (b) two sets of four vertical line display elements bridging, respectively, the aligned left ends and the aligned right ends of the five horizontal elements, whereby, (i) the highest, central and lowest horizontal elements and all the vertical elements are selectively displayable in combinations to display relatively large digits, (ii) the highest, second highest and second lowest horizontal elements and the vertical elements bridging the aligned ends thereof are selectively displayable in combinations to display smaller digits, relative to (i), in a relatively upper position, and (ii) the lowest, second lowest and second highest horizontal elements and the vertical elements bridging the aligned ends thereof are selectively displayable to display smaller digits, relative to (i), in a relatively lower position.

20. An array as in claim 19 in which the second highest and second lowest horizontal elements are spaced apart from each other and from, respectively, the highest and lowest horizontal elements, by distances which are approximately equal and which each is approximately one-third of the total vertical distance between the highest and lowest horizontal elements.

21. An array as in claim 19 or 20 in which the central horizontal element is positioned approximately mid-way between the highest and lowest horizontal elements.

22. An array as in claim 19 in which the ends of the highest, second highest, second lowest and lowest horizontal elements and of the vertical elements adjoining thereto are proximate and configured as mitered joints.

23. An array as in claim 19 in which the ends of the central horizontal element and of the vertical elements adjoining thereto are proximate and configured as butt joints.

* * * * *